US009676589B2

(12) United States Patent
Chachere

(10) Patent No.: US 9,676,589 B2
(45) Date of Patent: Jun. 13, 2017

(54) DEVICE AND METHOD USABLE FOR INSTALLING CABLE INTO A WINCH SPOOL

(71) Applicant: Richard Lee Chachere, Beaumont, TX (US)

(72) Inventor: Richard Lee Chachere, Beaumont, TX (US)

( * ) Notice: Subject to any disclaimer, the term of this patent is extended or adjusted under 35 U.S.C. 154(b) by 441 days.

(21) Appl. No.: 14/245,493

(22) Filed: Apr. 4, 2014

(65) Prior Publication Data

US 2015/0284213 A1 Oct. 8, 2015

(51) Int. Cl.
*B65H 59/22* (2006.01)
*B65H 49/32* (2006.01)

(52) U.S. Cl.
CPC ..... *B65H 59/22* (2013.01); *B65H 49/327* (2013.01); *B65H 2701/35* (2013.01)

(58) Field of Classification Search
CPC ..... B65H 59/22; B65H 59/043; B66D 1/34; B66D 1/36; B66D 1/42; B66C 13/10
USPC ..... 242/615.3; 254/323
See application file for complete search history.

(56) References Cited

U.S. PATENT DOCUMENTS 2,229,787 A * 1/1941 Abbott ..... B21C 47/34 242/557
2,394,381 A 2/1946 Hoern
2,726,050 A * 12/1955 Jones ..... E02F 3/96 242/390.7
2,967,390 A * 1/1961 McCormick ..... B29D 23/001 156/148
3,048,369 A * 8/1962 Hanson ..... B66B 7/06 242/157 R
3,494,595 A * 2/1970 Bohan ..... B64C 1/22 242/125.1
3,547,276 A * 12/1970 Thornburg ..... B66C 13/10 242/380
3,881,647 A 5/1975 Wolfe
3,918,592 A * 11/1975 Paul ..... B66C 23/36 212/181
4,012,003 A * 3/1977 Cochran ..... B65H 23/182 242/420.1
4,023,744 A 5/1977 Shutt
4,227,678 A 10/1980 Laky
4,383,792 A * 5/1983 Seabloom ..... B60P 3/125 212/294
4,568,036 A * 2/1986 Kearney ..... B66D 1/005 242/392

(Continued)

*Primary Examiner* — Emmanuel M Marcelo

(57) ABSTRACT

Apparatus and methods usable for introducing tension into a cable. The apparatus comprises a frame adapted for connection to a crane, a holder adapted for retaining a cable spool, and at least one surface adapted to contact the cable and resist its movement. The frame is adapted for disassembly into a plurality of sections. The apparatus comprises at least one bracket for connecting the frame with the crane. The bracket comprises an aperture adapted for connecting to a jib attachment of a boom head. The at least one surface comprises at least two surfaces adapted to compress the cable, thereby resisting its movement. The at least two surfaces comprise a channel extending thereon, wherein the channels are adapted to form a generally circular bore when the surfaces are joined together, wherein the bore is adapted for receiving the cable.

19 Claims, 5 Drawing Sheets

(56) References Cited

U.S. PATENT DOCUMENTS

| | | | | |
|---|---|---|---|---|
| 4,777,976 | A | 10/1988 | Johnston et al. | |
| 4,830,298 | A * | 5/1989 | Van Blunk | B29C 53/8016 242/157 R |
| 5,009,353 | A | 4/1991 | Alquist | |
| 5,368,212 | A | 11/1994 | Koch | |
| 5,669,566 | A * | 9/1997 | Puryear | A01K 89/0102 242/157 R |
| 5,758,685 | A | 6/1998 | Tisbo et al. | |
| 6,138,992 | A * | 10/2000 | Bell | B66D 1/00 224/519 |
| 6,494,437 | B1 * | 12/2002 | Boyer | B08B 9/0436 212/232 |
| 6,644,583 | B2 | 11/2003 | Schmidt | |
| 6,896,243 | B2 | 5/2005 | Theurer et al. | |
| 7,124,980 | B2 * | 10/2006 | Giovannoni | B65H 57/06 242/125 |
| 7,168,393 | B2 * | 1/2007 | Bogdahn | A01K 27/004 119/796 |
| 7,380,742 | B2 | 6/2008 | Stevens | |
| 7,748,659 | B2 | 7/2010 | Fabian | |
| 7,845,622 | B1 * | 12/2010 | Riggs | B66C 23/44 212/180 |
| 8,157,201 | B2 * | 4/2012 | Galgano | B62B 1/14 242/557 |
| 2003/0132335 | A1 * | 7/2003 | Schmidt | B65H 59/22 242/419.4 |
| 2009/0277857 | A1 * | 11/2009 | Rice | B66C 23/44 212/302 |
| 2012/0056045 | A1 * | 3/2012 | Franta | B65H 57/06 248/49 |
| 2012/0080652 | A1 | 4/2012 | Mann | |
| 2015/0076266 | A1 * | 3/2015 | Crawford | B66D 1/52 242/156.1 |

* cited by examiner

DEVICE AND METHOD USABLE FOR INSTALLING CABLE INTO A WINCH SPOOL

FIELD

Embodiments usable within the scope of the present disclosure relate, generally, to devices and methods for installing cable or flexible line onto a crane winch spool, and more particularly, but not by way of limitation, to devices that retain a spool of cable thereon, which can be attachable to a crane, and which can maintain the cable under tension as the cable is being wound onto a crane winch spool.

BACKGROUND

The operation of a crane requires periodic replacement of the cable, wire, rope, or any other flexible line that is wound on a crane winch spool. Although the use of cranes is commonplace, proper cable storage and installation procedures are less well known. As kinks, binding, or uneven winding can damage or seriously weaken the cable, proper cable storage and installation techniques must be followed to avoid damaging the cable.

Therefore, to maximize the life of a cable and to insure proper installation, the cable must be wound onto the cable spool tightly, under proper tension. Loose windings and spaces between windings are undesirable and each layer must be completed before the next layer is started. Any space between windings may permit the overriding layer to fall down to a lower layer and become jammed or wedged between the lower windings. A cable jammed in such a manner is easily frayed, kinked, or damaged.

Proper cable installation is typically accomplished utilizing manually operated tensioning devices. For example, the cable needs to be extended and a load placed at the end of the cable in order to assure that the cable is tight and tracking properly on a spool. To accomplish this, the cable is typically first unwound from a new cable spool and, then, the end of the cable is secured to a load or an immovable object. Thereafter, the crane or the load, attached thereto, is backed away until tension is introduced into the cable. Next, the crane winch spool is turned to wind the cable thereon, while the cable remains under tension due to the mass of the crane or the friction of pulled load against the ground. As the cable is wound onto the spool, tension is retained in the cable windings.

Several problems are associated with the above procedure. One problem is that, as the cable is laid out on the ground, sand or earth particles can be caught between threads of the cable. Such debris acts as an abrasive within the cable and weakens the cable over time. Another problem is the inability to precisely and repeatedly introduce proper tension into the cable, due to the resistance between the load and the crane not being precisely controlled as the cable is wound onto the winch spool.

Devices have been developed to improve and simplify the process of installing cable onto a crane. Other devices have been developed to apply tension to cable as it is wound onto a spool. Although, some devices include various mechanisms to distribute cable evenly and under tension, they are still needlessly complex and incapable of being used with existing cranes. Some devices include a series of sheaves, which resist rotation, thereby creating tension in the cable as it is fed therethrough and wound onto a winch spool. Some devices incorporate bars or plates that ride against the cable windings to hold the cable down against the spool and prevent the cable from coming loose. These bars or plates are biased against the spool with springs or similar mechanisms. Although the bars and plates hold the cable against the spool, these devices do not accurately maintain tension in the cable or ensure that the cable is wound evenly and tightly on the spool. In yet other devices, the cable is fed through traction rollers, which resist rotation, wherein the traction rollers rub against the cable as it is wound onto or from a spool.

There is a need for a simple device that introduces tension into a cable as it is wound onto a winch spool. There is a need for a cable-installing device that is compact and requires minimal space during operation. There is a need for a cable-installing device usable with a stationary or a mobile crane, wherein the device can be operated by a single person to properly and quickly install cable onto a crane spool. There is a need for a cable-installing device that is compact, portable, and can be easily assembled and disassembled.

SUMMARY

The present disclosure is directed to an apparatus usable for installing cable onto a crane. The apparatus can comprise a frame, a first connector and a second connector, a holder adapted for retaining a cable spool, and a first surface and a second surface, wherein the first surface and the second surface can be adapted for receiving a cable therebetween and contacting the cable. The first connector and the second connector can be adapted for connecting the frame to a crane. The holder can be connected to the frame and can allow the cable spool to rotate. In another embodiment of the apparatus the first surface, the second surface, or combinations thereof can resist the movement of the cable therebetween and the first surface, the second surface, or combinations thereof can be connected to the frame.

The present disclosure is further directed to an apparatus for introducing tension in a flexible line. The apparatus can comprise a frame adapted for rotatably connecting a spool thereto, at least one bracket connected to the frame, and at least one surface connected to the frame. The at least one bracket can be adapted for connection to a crane and the at least one surface is adapted for contacting the flexible line. In another embodiment of the apparatus, the at least one bracket can be adapted for connecting to a jib attachment or a sheave pin of a crane and the at least one surface can be adapted to compress the flexible line to resist movement of the flexible line.

The present disclosure is also directed to a method for installing cable under tension. The method can comprise the steps of connecting an apparatus to a boom head of a crane, connecting a cable spool to the apparatus, positioning a cable in contact with at least one surface, pulling the cable to introduce tension into the cable, and rotating the cable spool. In an embodiment of the method, the at least one surface can resist motion of the cable The foregoing is intended to give a general idea of the invention, and is not intended to fully define nor limit the invention. The invention will be more fully understood and better appreciated by reference to the following description and drawings.

BRIEF DESCRIPTION OF THE DRAWINGS

In the detailed description of various embodiments usable within the scope of the present disclosure, presented below, reference is made to the accompanying drawings, in which.

One or more embodiments are described below with reference to the listed Figures.

DETAILED DESCRIPTION OF THE EMBODIMENTS

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, order of operation, means of operation, equipment structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products and may include simplified conceptual views as desired for easier and quicker understanding or explanation. As well, the relative size and arrangement of the components may differ from that shown and still operate within the spirit of the invention. It should also be noted that like numbers appearing throughout the various embodiments and/or figures represent like components.

Moreover, it will be understood that various directions such as "upper," "lower," "bottom," "top," "left," "right," and so forth are made only with respect to explanation in conjunction with the drawings, and that the components may be oriented differently, for instance, during transportation and manufacturing as well as operation. Because many varying and different embodiments may be made within the scope of the concepts herein taught, and because many modifications may be made in the embodiments described herein, it is to be understood that the details herein are to be interpreted as illustrative and non-limiting.

Embodiments within the scope of the present disclosure relate to an apparatus and methods usable to introduce tension into a cable as it is being wound onto a crane winch spool. The apparatus can be portable and can be assembled and disassembled for storage and transportation. The installer can be attached directly to the boom head of the crane and can be used to feed cable, under tension, onto the crane winch spool.

Figure 1:
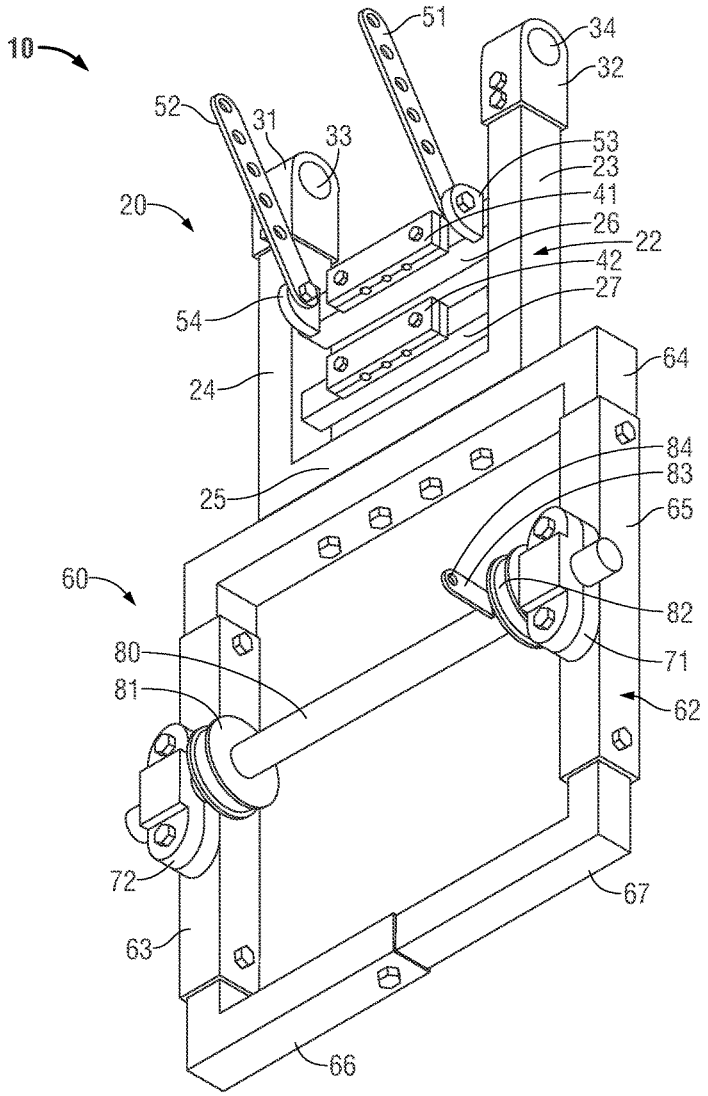
FIG. 1 depicts an isometric view of an embodiment of the device usable within the scope of the present disclosure.
Figure 2:
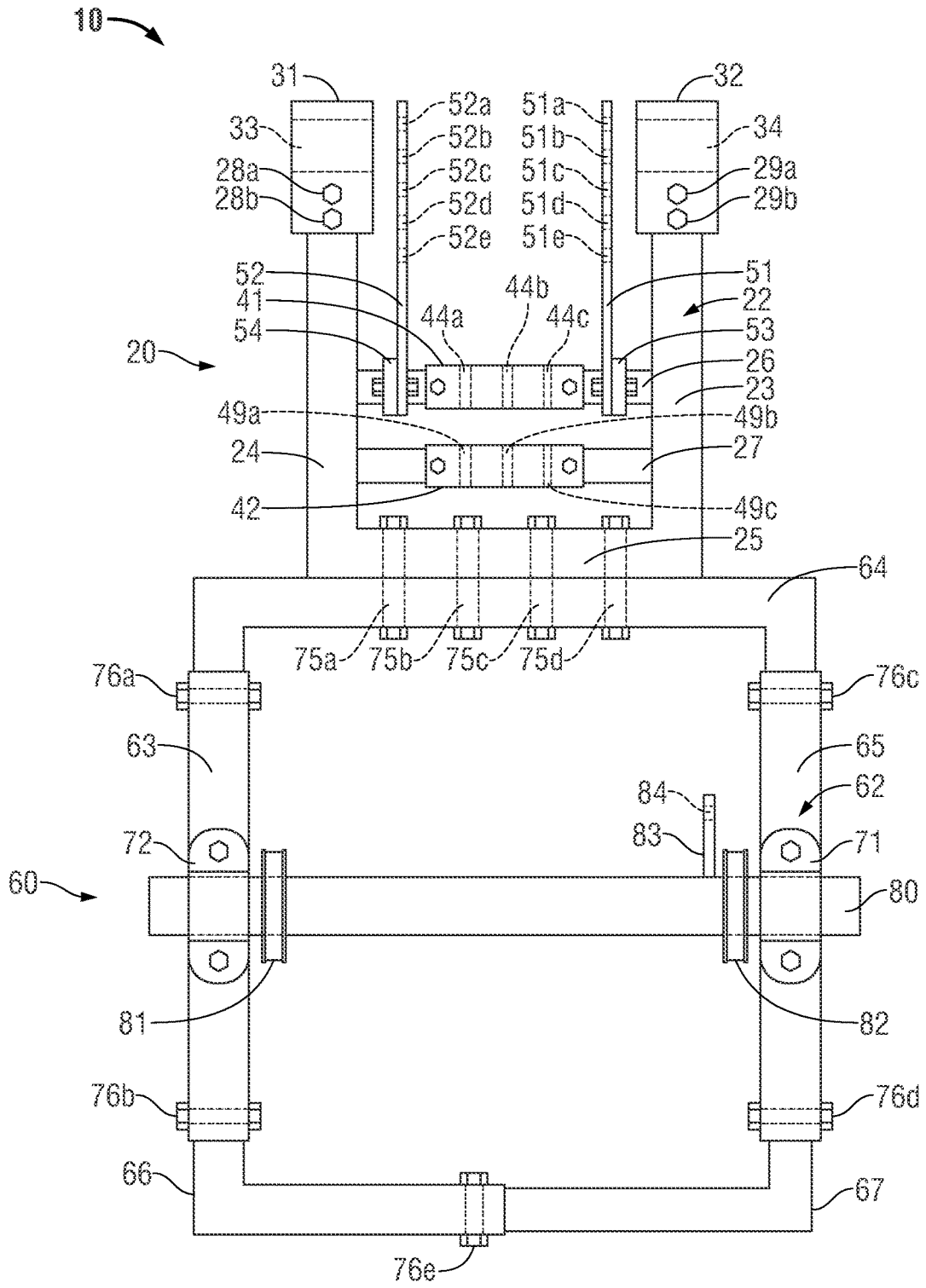
FIG. 2 depicts a diagrammatic front elevational view of an embodiment of the device usable within the scope of the present disclosure.

Referring now to FIGS. 1 and 2, a front view and an isometric view of an embodiment of the cable installer device (10) is shown. The depicted cable installer device (10) includes an upper section (20) comprising an upper frame assembly (22), two friction pads (41, 42), two stabilizer bars (51, 52), and two boom head connectors (31, 32). The cable installer device (10) can include a lower section (60), which can comprise a lower frame assembly (62) and a spool support shaft (80), as shown.

As shown, the depicted upper frame assembly (22) of the upper section (20) comprises two vertical beams (23, 24) and a horizontal beam (25) connected in a generally U-shaped configuration. The upper frame assembly (22) is depicted including two horizontal cross beams (26, 27), positioned parallel between the vertical beams (23, 24), wherein the cross beams (26, 27) add structural integrity to the upper frame (22). In another embodiment of the cable installer (10), the upper frame (22) may comprise a plurality of beams that can be disassembled. For example, the vertical beams (23, 24) may be connected to the horizontal beam (25) and the cross beams (26, 27) with bolts or other connectors, allowing the upper frame (22) to be disassembled for compact storage or transportation.

The depicted lower frame assembly (62) of the lower section (60) is designed to accommodate and support a cable spool (101, see FIGS. 3 and 4) during cable installation operations. As depicted in FIGS. 1 and 2, the lower frame (62) comprises a plurality of steel beams formed into a generally a rectangular shape. The lower frame (62) can include a spool support shaft (80) (e.g., a spool holder) adapted for retaining a cable spool in connection with the lower frame (62). The depicted spool support shaft can extend horizontally through the center of the cable spool (101), with each end of the shaft (80) being supported by opposite vertical beams (63, 65) at approximately the center of the lower frame, between the upper and lower horizontal beams (64, 66, 67). The shaft (80) can be connected to the vertical beams (63, 65) of the lower frame (62) by clamp assemblies (71, 72), which support each end of the shaft (80). Lastly, as a cable spool (101) (e.g. shipping spool) can weigh between 500 to 1000 pounds or more, the shaft (80) and the clamps (71, 72) can comprise any material having sufficient strength to support the weight of the spool (101) of cable. The clamp assemblies (71, 72) can be adapted to grasp the shaft (80) with sufficient force to prevent free shaft rotation. However, the shaft can rotate during cable installation procedures, as external torque is introduced into the shaft (80).

Figure 3:
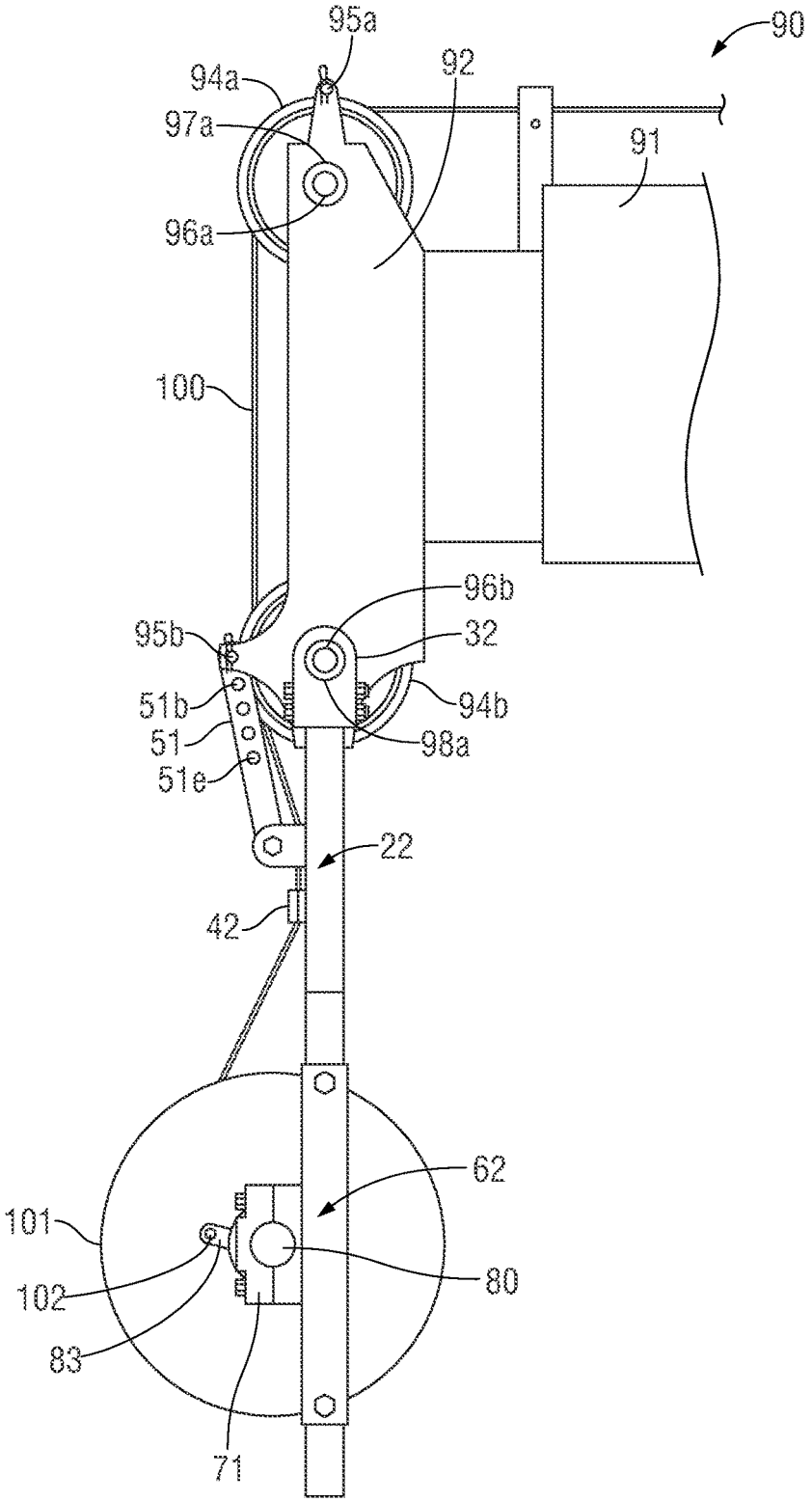
FIG. 3 depicts a side elevational view of an embodiment of the device usable within the scope of the present disclosure connected to a crane.
Figure 4:
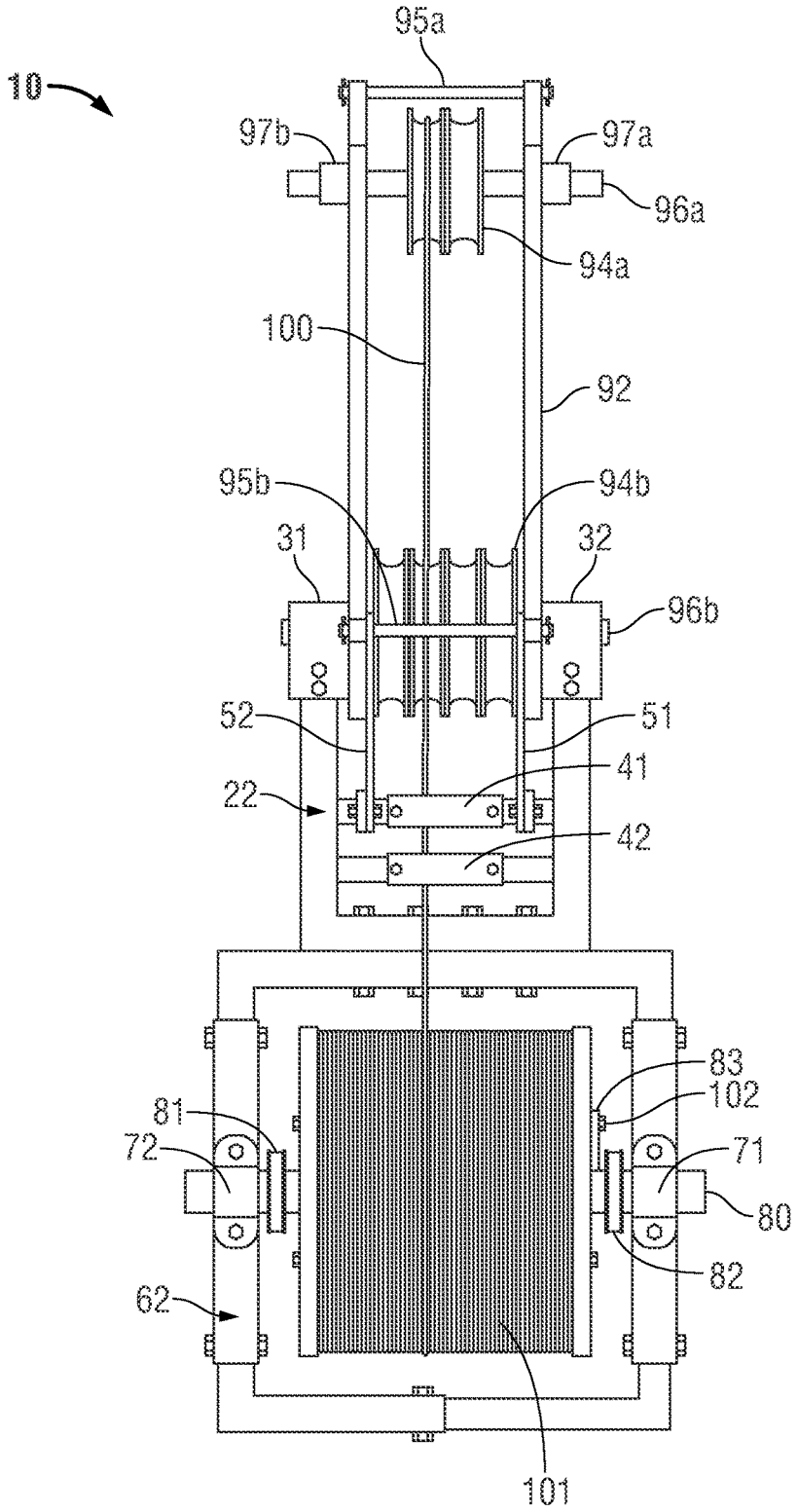
FIG. 4 depicts a front elevational view of an embodiment of the device usable within the scope of the present disclosure connected to a crane.

As further depicted in FIGS. 1 and 2, the lower section (60) comprises two cylindrical spacers (81, 82) slidably positioned about the shaft (80). During cable installation operations, the spacers (81, 82) can maintain the spool toward the center of the shaft (80) and the lower frame (62), away from the vertical beams (63, 65). Lastly, the shaft (80) is depicted comprising a shaft connection bracket (83) extending therefrom, adjacent to the second spacer (82). The shaft connection bracket (83) is depicted as a rectangular bar extending laterally from the shaft (80) and comprising a hole (84) extending through the end thereof. During cable installation operations, the shaft connection bracket (83) prevents the shaft (80) from sliding out of the mounting clamps (71, 72). The shaft connection bracket (83) can be connected to the cable spool (101), as depicted in FIGS. 3 and 4, by inserting a long rod or bolt (not shown) through the bracket hole (84) and through the width of the spool (101). The bolt can be locked in position through the spool (101) and the bracket (83) with retaining nuts (102), thereby connecting the shaft (80) with the cable spool (101). In another embodiment (not shown) of the cable installer (10), the hole (84) can be elongated or comprise a slot, thereby allowing the bracket (83) to be connected with spool tie rods located at different positions on a cable spool (101).

An embodiment of the cable installer device (10) of the current disclosure can be disassembled for transport or storage. As depicted in FIGS. 1 and 2, the upper and lower sections (20, 60) can be connected by four bolts (75*a-d*) extending between the horizontal beam (25) of the upper frame (22) and the upper horizontal beam (64) of the lower frame (62). Although the depicted embodiment of the cable installer device (10) is shown having the upper frame (22) and the lower frame (62) as separate components, configured for attachment with a plurality of bolts (75*a-d*), it should be understood that in another embodiment (not shown), the upper and lower frames (22, 62) can be permanently attached to each other by any means known in the art, including welding. In yet another embodiment (not shown) of the cable installer (10), the upper and lower frames (22, 62) can be integrally formed, resulting in a single frame, having common vertical beams and a plurality of horizontal beams extending between the vertical beams.

As further depicted in FIGS. 1 and 2, the lower frame can be disassembled into a plurality of segments for compact storage or transport. In the depicted embodiment, the upper, lower, and vertical beams (63-67) can be separate and distinct members connectable by threaded bolts (76*a-e*). Specifically, FIGS. 1 and 2 depict horizontal beams (64, 66, 67) having vertical ends, which are inserted into the vertical beams (63, 65) and bolted together. The second lower horizontal beam (67) is shown being inserted into the first horizontal beam (66) and bolted together. In order to connect the lower frame (62) together using bolts, the ends of the beams (63-67) can comprise holes extending laterally therethrough. As the lower frame (62) is assembled, the holes in the beams (63-67) align, whereby the beams can be joined together by the bolts (76*a-e*).

Although FIGS. 1 and 2 depict the vertical beams (63, 65) having a larger diameter than the horizontal beams (64, 66, 67), in another embodiment (not shown), each vertical beam may be smaller in diameter than the vertical portions of the horizontal beams and would therefore be inserted into each vertical portion of the horizontal beams. In yet another embodiment (not shown) of the cable installer (10), the lower frame (62) may be further broken down into additional sections, resulting in smaller individual frame components.

Furthermore, although FIGS. 1 and 2 depicts the framing assembly comprising beams having a square cross-section, any beam types or shapes, including round beams, I-beams, angle beams, channel beams, or solid bars are components usable to fabricate the upper and lower frames (22, 62) and are within the scope of present disclosure. Also, in an embodiment, the material usable to fabricate the upper and lower frames (22, 62) may be Aerospace Material Specifications (AMS) 5340 cast corrosion and heat resistant steel alloy. However, any metal, structural steel, or steel alloys having sufficient structural strength to support a spool of cable can be usable and is within the scope of the present disclosure.

In an embodiment of the cable installer apparatus (10), the bolts can comprise Society of Automotive Engineers (SAE) Grade 8 bolts, or any other type or grade of bolts capable of safely maintaining the integrity of the cable installer (10) during operations. It should be understood that the number and the position of bolts can vary without departing from the scope of the present disclosure. Although a specific number and location of bolts are depicted in the embodiment of the cable installer (10), as depicted in FIGS. 1 and 2, any bolt configuration, which is capable of maintaining the integrity of the cable installer (10), can be usable within the scope of the present disclosure. Lastly, it should be understood that in other embodiments (not shown) of the cable installer (10), the use of bolts (75*a-d*, 76*a-e*) to maintain the integrity of the cable installer (10), may not be necessary, whereby the upper and lower frames (22, 62) can be welded together, to form a single frame assembly, or held together with clamps, latches, pins, or by any other means known in the art.

Referring again to FIGS. 1, 3 and 4, an embodiment of the cable installer (10) in accordance with the present disclosure is shown. The upper section (20) is shown comprising two boom head connectors (31, 32) (e.g., connecting brackets) that are connected to the upper ends of the vertical beams (23, 24). The boom head connectors (31, 32) are usable to connect the cable installer apparatus (10) to the boom head (92) of a crane (90). Each boom head connector (31, 32) is depicted having a bore (33, 34) (e.g., an aperture) extending laterally through the upper portion thereof, and two bolt holes extending laterally through the lower portion thereof. The lower portion of the boom head connectors (31, 32) can be placed about the upper end of the vertical beams (23, 24) and connected together by bolts (28*a-b*, 29*a-b*) shown in FIG. 2, extending through the bolt holes and the vertical beams. The bores (33, 34) can be adapted to accept jib attachments (97*a-b*, 98*a-b*, 98*b* not shown), or similar protrusions, extending on each side of the boom head (92). The jib attachments (97*a-b*, 98*a-b*, 98*b* not shown), as depicted in FIGS. 3 and 4, can be used to connect a jib extension to the boom head (92). In another embodiment (not shown) of the cable installer (10), the bores (33, 34) can be adapted to directly accept the ends of the upper or lower boom head sheave pins (96*a*, 96*b*) protruding on each side of the boom head (92). The boom head sheave pins (96*a*, 96*b*) or similar shafts, as depicted in FIGS. 3 and 4, support a set of cable sheaves (94*a*, 94*b*) and often extend through the boom head (92).

Furthermore, an alternate embodiment (not shown) of the cable installer (10) may include boom head connectors (31, 32) comprising ball bearings, roller bearings, wear resistant material, or devices positioned within the bores (33, 34), enabling smoother rotation of the cable installer (10) in relation to the boom head (92). It should be understood that although the embodiment of the cable installer (10), depicted in FIGS. 3 and 4, depicts the use of boom head connectors (31, 32), in other embodiments (not shown) of the cable installer (10) the boom head connectors (31, 32) may be replaced by clamps, brackets, hooks, or any other connector types known in the industry, which are adapted to attach the cable installer (10) to the boom head jib attachments (97*a-b*, 98*a-b*, 98*b* not shown), the sheave pins (96*a*, 96*b*), or to any other portion of a boom head (92).

Figure 6:
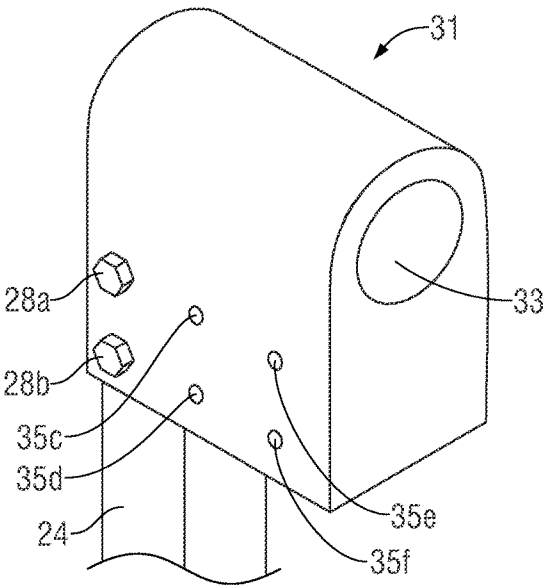
FIG. 6 depicts an isometric view of an embodiment of a boom head connector usable within the scope of the present disclosure.

Furthermore, to accommodate for larger or smaller boom heads (not shown), the separation between the vertical beams (24, 25), and thereby the separation between the boom head connectors (31, 32), can be adapted to match the distance between the boom head jib attachments (97*a-b*, 98*a-b*, 98*b* not shown), the ends of the sheave pins (96*a*, 96*b*), or any other portions extending from the boom head (92). In another embodiment (not shown) of the cable installer (10), the bores (33, 34) can receive a shaft extending therethrough, wherein a set of clamps, brackets, hooks, or other connectors, can engage both the shaft and the jib attachments (97*a-b*, 98*a-b*, 98*b* not shown), the sheave pins (96*a*, 96*b*), or any other portion of a boom head (92) to establish a connection between the boom head (92) and the cable installer (10). In another embodiment of the cable installer (10), the boom head connectors (31, 32) can comprise a lower portion having multiple sets of bolt holes extending therethrough. Referring to FIG. 6, the first boom head connector (31) is comprises three sets of bolt holes (35*a-b*, 35*c-d*, 35*e-f*, 35*a-b* not shown) usable to connect the boom head connector (31) to the vertical beam (24) by bolts (28*a*, 28*b*). This results in different separation distances between the bores (33, 34) of the boom head connectors (31, 32), thereby allowing the cable tensioner (10) to be adjusted to larger or smaller boom heads. The second boom head connector (32) can be configured similarly to the first boom head connector (31).

The cable installer (10) can further comprise at least one bracket adapted to form an additional connection between the upper frame (22) and the crane (90) to stabilize the cable installer (10) in relation to the crane (90). The embodiment of the cable installer (10) shown in FIGS. 1, 3, and 4, depicts the at least one bracket as two stabilizer bars (51, 52), which can be pivotally attached to the upper cross beam (26). The stabilizer bars (51, 52) can comprise elongated rectangular bars having a plurality of holes (51*a-f*, 52*a-f*) extending laterally therethrough. A bolt can extend through the lower holes of the stabilizer bars (51, 52) and through the upper frame brackets (53, 54), which extend from the upper cross beam (26). In another embodiment (not shown), the upper frame brackets (53, 54) can include any number of holes, be connected to other portions of the frames (22, 62), and can comprise any configuration adapted to form a pivot connection with the stabilizer bars (51, 52). Furthermore, the upper portion of the stabilizer bars (51, 52) can be connected to the boom head (92), in order to prevent the cable installer (10) from swinging during cable installation operations. Specifically, any of the other holes (51*a-e*, 52*a-e*) can receive the upper or the front cable retainer pin (95*a*, 95*b*), which extend through the boom head (92), thus forming a second connection between the cable installer (10) and the boom head (92). Cable retainer pins (95*a*, 95*b*) or similar shafts, typically extending though the boom head (92), adjacent to the cable sheaves (94*a*, 94*b*), can be used to maintain the cable (100) thereon. FIGS. 3 and 4 depict the front cable retainer pin (95*b*) extending through the first holes (51*a*, 52*a*) of the stabilizer bars (51, 52). Although the depicted stabilizer bars (51, 52) are adapted to receive the retainer pins (95*a*, 95*b*), the holes (51*a-e*, 52*a-e*) can be adapted to receive any pin or similar shaft extending through the boom head (92). In another embodiment (not shown) of the cable installer (10), the stabilizer bars (51, 52) may be adapted to connect to any part of a boom head (92), providing a secondary connection between the boom head (92) and the cable installer (10).

The stabilizer bars (51, 52), depicted in FIGS. 1 and 3 can be used to adjust the angle of the cable installer (10) in relation to the boom head (92). Inserting the retainer pin (95*b*) through the holes (51*b-e*, 52*b-e*) along the intermediate portion of the stabilizer bars (51, 52), can shorten the connection length between the upper frame brackets (53, 54) and the retainer pin (95*b*), thereby pivoting the cable installer (10) about the jib extensions (98*a*, 98*b*, 98*b* not shown). Engaging successive intermediate holes (51*b-e*, 52*b-e*) with the retainer pin (95*b*) further shortens connection lengths, thereby further changing the angle at which the cable installer (10) can be positioned in relation to the boom head (92).

Figure 5:
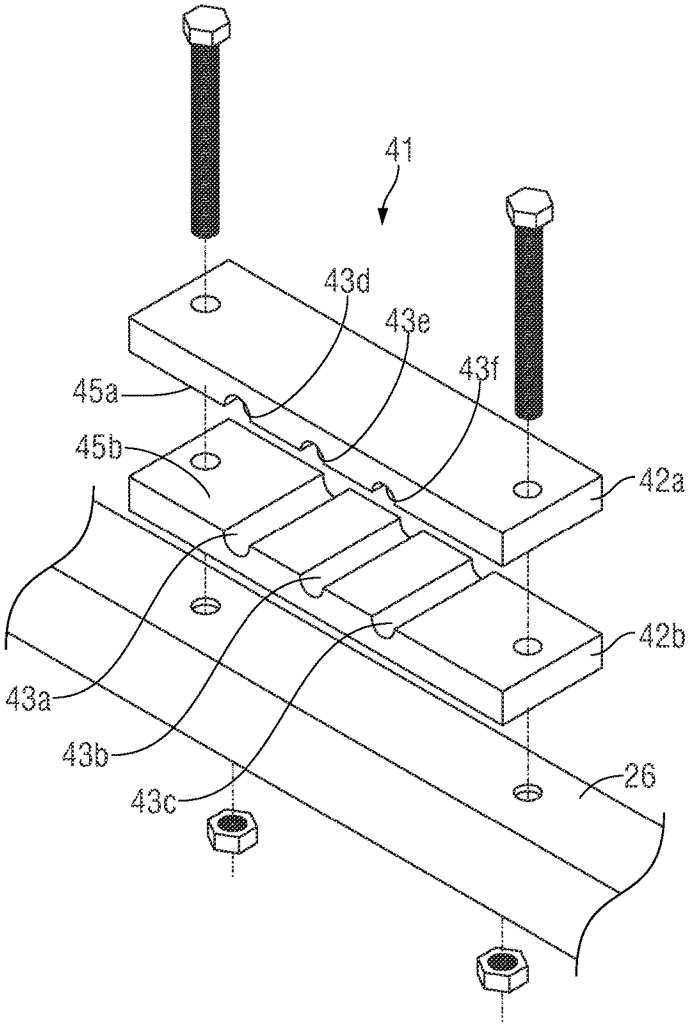
FIG. 5 depicts an exploded isometric view of an embodiment of a friction pad usable within the scope of the present disclosure.

Referring again to FIGS. 1 and 4, showing the installer device (10) in accordance with the present disclosure. Specifically, the Figures depict upper and lower horizontal cross beams (26, 27) supporting upper and lower friction pads (41, 42), respectively. FIG. 5 shows an exploded view of the upper friction pad (41) comprising a top plate (42*a*) having an inner surface (45*a*, not shown) and a bottom plate (42*b*) having an inner surface (45*b*), wherein each plate (42*a*, 42*b*) has three round or semicircular channels (43*a-f*) extending the width of each plate (42*a*, 42*b*) along their inner surfaces (45*a-b*). When the plates (42*a*, 42*b*) are assembled together, the semicircular channels (43*a-f*) form cylindrical bores (44*a-c*, shown in FIG. 2) extending through the upper friction pad (41). The bores (44*a-c*) of the upper friction pad (41) can comprise different sized diameters for accommodating cables having different diameters. To enable proper installation of the cable (100) onto a crane winch spool (not shown), the inside diameter of the bore (44*a-c*), comprising the cable (100) therein, can be smaller than the outside diameter of the cable (100), whereby the cable (100) can be compressed in the bore (44*a-c*) between the upper and lower plates (42*a*, 42*b*). In an embodiment of the cable installer (10), the bores (44*a-c*) formed through the friction pad (41) can comprise a diameter that is 0.025 inches larger than the diameter of the cable (100). As the cable is pulled through one of the bores (44*a-c*), it is compressed, resulting in friction between the cable (100) and the friction pad (41), thereby introducing tension into the cable (100) as it is wound onto the crane winch spool. In alternate embodiments (not shown) of the cable installer (10), the plates (42*a*, 42*b*) can comprise channels or grooves having any shape or configuration, including square or V-shaped grooves, and should not be limited to round channels (43*a-f*). Although the depicted embodiment of the cable installer (10) comprises friction pads (41, 42) having bores (43*a-c*), which are 0.025 inches larger than the diameter of the cable (100), other embodiments may comprise bores that are more than 0.025 inches larger than the diameter of the cable (100), if less friction force is desired, or less than 0.025 inches larger than the diameter of the cable (100), if more friction force is desired.

As cables, wires, ropes, and other flexible lines can comprise different diameters and physical properties, the upper friction pad (41) can comprise bores (44*a-c*) having different diameters extending therethrough. A friction pad, having bores with different diameters, can allow the operator to select a bore that would yield proper cable tension during cable installation. Specifically, a bore having a larger diameter can be selected if lesser tension is desired, while a bore having a smaller diameter can be selected if greater tension is desired. While the upper friction plate (41) was described above, the lower friction plate (42) can have the same or similar general configuration and comprise bores (49*a-c*) having the same or different diameter as the upper friction plate (41) bores (44*a-c*). Furthermore, the lower friction pad (42) allows the selection of bores (49*a-c*) having additional diameters, which are not provided by the upper friction pad (41), thereby accommodating cables having additional diameters. As depicted in FIGS. 3 and 4, the upper and lower friction pads (41, 42) can be used at the same time for introducing additional tension into the cable (100).

In an embodiment, the material usable to fabricate the friction pads (41, 42) may be AMS 5340 cast corrosion and heat resistant steel alloy. However, other metals, structural steel, steel alloys, or composite materials, having properties resistant to wear and heat, resulting from friction, are usable and are within the scope of the present disclosure. In another embodiment (not shown) of the cable installer (10), the inner surfaces (45*a-b*) and/or the bores (44*a-c*) of the friction pad (41) can comprise a coating of heat and/or wear resistant material. In another embodiment (not shown), the friction pad (41) may comprise two of more materials, wherein the material defining the bores (44*a-c*) and/or the inner surfaces (45*a-b*), can comprise any wear and/or heat resistant material described above.

The embodiment of the cable installer, shown in FIGS. 1 and 5, depicts each friction pad (41, 42) connected to the upper and lower cross beams (26, 27) by threaded bolts extending through the pads (41, 42) and the cross beams (26, 27). Bolts or other similar connectors enable the disconnection of either friction pad (41, 42) and/or the substitution of another friction pad (not shown) having differently configured bores. However, in other embodiments (not shown) of the cable installer (10), the friction pads can be attached to the upper frame (22) by any other means known in the art, for example the lower plate (42*b*) may be welded to a horizontal beam (26), with the top plate (42*a*) being bolted to the lower plate (42*b*). In another embodiment (not shown), the friction pads (41, 42) may be connected to the vertical beams (23, 24) or to any other portion of the frames (22, 62) that allow the cable to be fed therethrough. Although the embodiments depicted in FIGS. 1 and 5 depict a friction pad (41) having three bores (44*a-c*), it should be understood that each friction pad (41, 42) may include any number of bores extending therethrough, with each bore having a different diameter. Still other friction pads (not shown) can comprise a single orifice, whereby the cable installer (10) can be adopted for a different cable by removing the friction pad (41) and connecting another friction pad having a different bore. In another embodiment (not shown) of the cable installer (10), the friction pads (41, 42) may be slidably connected to the horizontal cross beams (26, 27), allowing each friction pad (41, 42) to move (e.g., slide) along the length of each horizontal beam (26, 27), in a generally perpendicular direction relative to the cable (100) during installation, while simultaneously compressing the cable (100) to create tension therein.

As the purpose of the friction pads (41, 42) is to resist the passage of the cable (100) therethrough to introduce tension into the cable (100) as it is wound onto the crane winch spool (not shown), other means of introducing tension into the cable (100) may be incorporated into the cable installer (10) and are within the scope of this disclosure. For example, other devices, such as rollers (not shown) that engage the cable while resisting rotation, can replace or work in conjunction with the friction pads (41, 42). During cable installation, the cable (100) may be forced against or compressed between the rollers and pulled therethrough, introducing tension into the cable (100) as it is wound onto the winch spool.

Referring again to FIGS. 3 and 4, an embodiment of a cable installer device (10), in accordance with the present disclosure, is shown connected to a typical mobile crane (90). The depicted crane (90) is shown having a boom (91) with a boom head (92) at the end thereof. The boom head (92) is shown encompassing upper and lower cable sheaves (94*a*, 94*b*) maintained in position by two boom head sheave pins (96*a*, 96*b*) extending through the cable sheaves (94*a*, 94*b*) and the boom head (92). The Figures further depict four jib attachments (97*a-b*, 98*a-b*, 98*b* not shown) extending on each side of the boom head (92), concentrically about the sheave pin (96*a*, 96*b*) segments extending through the boom head (92). The Figures also depict a spool (101) of cable (100), wherein the cable (100) extends through the upper and lower friction pads (41, 42), through the upper and lower cable sheaves (94*a*, 94*b*), and towards the back end of the crane (90), for connection to the winch spool (not shown). The boom head (92) is also depicted comprising a front cable retainer pin (95*b*) extending through the boom head (92) in front of the lower cable sheaves (94*b*), and a top cable retainer pin (95*a*) extending through the boom head (92) above the upper cable sheaves (94*a*).

To introduce tension into the cable (100), as it is being wound onto the crane winch spool (not shown), the cable installer (10) can be temporarily connected to the boom head (92), as depicted in the embodiment of the cable installer (10) shown in FIGS. 3 and 4. In an embodiment of cable installation operations, the lower frame (62) can first be assembled and connected to the upper frame (22), thereafter, the stabilizer bars (51, 52) can be connected to the upper frame (22). Next, the boom head connectors (31, 32) can be positioned about the jib attachments (98*a*, 98*b*, 98*b* not shown) of the boom head (92). Once the boom head connectors (31, 32) are attached, the vertical beams (23, 24) of the upper frame (22) can be inserted into and locked within the boom head connectors (31, 32), thereby connecting the cable installer (10) to the boom head (92) of the crane (90). The stabilizer bars (51, 52) can be connected to the boom head (92) by removing the front cable retainer pin (95*b*) from the boom head (92) and inserting the retainer pin (95*b*) through the upper holes (51*a*, 52*a*), or any other holes (51*b-e*, 52*b-e*), of the stabilizer bars (51, 52), after which, the retainer pin (95*b*) can be re-inserted through the boom head (92).

At this point, the cable installer (10) is rigidly connected to the boom head (92), and the cable spool (101) can be connected to the lower frame (62). In order to connect the cable spool (101) to the lower frame (62), the spool support shaft (80) can first be inserted through the axial opening in the side of the spool (101), and a rod or a bolt can be inserted through the hole (84) of the shaft bracket (83) and extend through the spool (101) to lock the shaft (80) with the spool (101). The bolt can be retained in position by nuts (102), as shown in FIG. 4. Once the shaft (80) is inserted into the spool (101), the spacers (81, 82) and the clamps (71, 72) can be positioned about the shaft (80), on both sides of the spool (101), which can be connected to the lower frame (62). As the cable spool (101) can weigh hundreds of pounds, it can be lifted into position against the lower frame (62) by a forklift, a crane, or by any another means (not shown). Alternatively, once the cable installer (10) is connected to the boom head (92), the boom (91) can be maneuvered by a crane operator, whereby the lower frame (62) of the cable installer (10) is moved into position against the spool (101). Once the shaft (80) and the spool (101) are properly aligned against the lower frame (62), bolts can be inserted through the clamps (71, 72) and engaged with the vertical beams (63, 65) of the lower frame (62), thereby connecting the spool (101) with the cable installer (10).

When the cable spool (101) is connected to the cable installer (10), the end of the cable (100) can then be fed through the lower cable sheave (94*b*), the upper cable sheave (94*a*), and connected to the winch spool (not shown) located at the opposite end of the boom (91). Thereafter, the upper and/or lower friction pads (41, 42) can be positioned about the cable (100) and bolted to the cross beams (26, 27), compressing the cable (100) therebetween, within the selected bores (44*a-c*, 49*a-c*).

Once the cable (100) is compressed within the upper and lower friction pads (41, 42), as shown in FIGS. 3 and 4, and the end of the cable (100) can be connected to the crane spool (not shown). During installation operations, the spool (101) rotates to supply new cable (100) to the crane spool, which is rotated by a motor to pull the cable (100) thereon. As the cable (100) can be pulled by the crane spool through the bores (44*a-c*, 49*a-c*) of the friction pads (41, 42), the resulting friction therebetween resists the movement of the cable therethrough, thereby introducing tension into the cable (100). During cable installation, the cable (100) can be oiled to reduce the friction between the cable (100) and the friction pads (41, 42). The oil can be usable to reduce wear on the cable (100) as it is forced though the friction pads (41, 42).

In yet another embodiment (not shown) of the cable installer (10), the cable installer (10) can be used to receive or pull old cable from the crane spool onto an empty spool (not shown) prior to new cable (100) being installed. In such an embodiment of the cable installer (10), the spool support shaft (80) can be operatively connected to a motor (not shown), which can rotate the shaft (80) and, therefore, an empty spool, to pull, receive, and/or wind old cable from the crane spool onto the empty spool. This process can be essentially the opposite of the cable installation process described above. The motor can be attached directly to the shaft (80), wherein the motor output shaft is connected in line with the shaft (80). In another embodiment, the motor can be attached to the shaft (80) by gears, a chain and sprocket assembly, a belt assembly, or by any other means known in the art. The frame of the motor can be connected to the frame assembly (62) to retain the motor in position. The motor can be of any type known in the art, including a hydraulic, pneumatic, or electrical motor.

While various embodiments usable within the scope of the present disclosure have been described with emphasis, it should be understood that within the scope of the appended claims, the present invention can be practiced other than as specifically described herein.

What is claimed is:

1. An apparatus usable in installing cable onto a crane, the apparatus comprising:

a frame comprising a plurality of beams adapted for connecting and disconnecting to each other;

a first connector and a second connector, wherein the first connector and the second connector are adapted for connecting the frame to the crane;

a holder adapted for retaining a cable spool, wherein the holder is connected to the frame, wherein the holder allows the cable spool to rotate; and a first surface and a second surface, wherein the first surface and the second surface are adapted for receiving a cable therebetween and contacting the cable, wherein the first surface, the second surface, or combinations thereof resist the movement of the cable therebetween, wherein the plurality of beams of the frame are adapted for temporary connection to each other by a plurality of bolts, clamps, brackets, or combinations thereof, and wherein the first surface, the second surface, or combinations thereof are connected to the frame.

2. An apparatus of claim 1, wherein the frame is adapted for disassembly into a plurality of frame sections.

3. An apparatus of claim 1, further comprising a bracket connected to the frame and adapted for connection to the crane, wherein the bracket is adapted to stabilize the frame in relation to the crane.

4. The apparatus of claim 1, wherein the first and the second connectors are adapted for connecting to a boom head.

5. The apparatus of claim 1, wherein each connector of the first and the second connectors comprises an aperture adapted for receiving a jib attachment or a sheave pin.

6. The apparatus of claim 1, wherein the first and the second surfaces are adapted for compressing the cable therebetween, thereby creating friction between the first and the second surfaces and the cable, as the cable is being pulled therebetween.

7. The apparatus of claim 1, wherein the first surface comprises a first channel extending thereon, wherein the second surface comprises a second channel extending thereon, wherein the first and the second surfaces are adapted to form a round bore when joined together, and wherein the bore is adapted for receiving the cable.

8. The apparatus of claim 1, wherein the holder comprises an elongate cylindrical member adapted for receiving the cable spool and for maintaining the cable spool rotatably connected to the frame.

9. The apparatus of claim 1, wherein the holder is adapted to resist free rotation of the cable spool.

10. An apparatus for introducing tension in a flexible line, the apparatus comprising:

a frame comprising a plurality of beams, wherein the plurality of beams are adapted for temporarily connecting and disconnecting to each other by a plurality of bolts, clamps, brackets, or combinations thereof, and wherein the frame is adapted for rotatably connecting a spool thereto;

at least one bracket connected to the frame, wherein the at least one bracket is adapted for connection to a crane; and at least one surface connected to the frame, wherein the at least one surface is adapted for contacting the flexible line.

11. The apparatus of claim 10, wherein the at least one bracket is adapted for connecting to a jib attachment or a sheave pin.

12. The apparatus of claim 10, wherein the at least one surface is adapted to compress the flexible line to resist movement of the flexible line.

13. The apparatus of claim 10, wherein the at least one surface comprises at least two surfaces adapted to compress the flexible line therebetween to resist relative movement of the flexible line.

14. The apparatus of claim 10, wherein the at least one bracket comprises first and second brackets, wherein each bracket has an aperture extending therethrough, and wherein the apertures are adapted for receiving jib attachments, a sheave pin, protrusions, or combinations thereof.

15. A method usable for installing cable under tension, the method comprising the steps of:

assembling a frame from a plurality of beams adapted for temporarily connecting and disconnecting from each other by a plurality of bolts, clamps, brackets, or combinations thereof, connecting a cable spool to the frame;

positioning a cable in contact with at least one surface, whereby the at least one surface resists motion of the cable;

pulling the cable, thereby introducing tension into the cable; and rotating the cable spool.

16. The method of claim 15, wherein the step of connecting the frame to the boom head of the crane comprises connecting the frame to a jib attachment, a sheave pin, a protrusion extending from the boom head of the crane, or combinations thereof.

17. The method of claim 15, wherein the step of connecting the frame to the boom head of the crane comprises:

positioning a first connector about a first jib attachment, a first portion of a sheave pin, a first protrusion extending from the boom head of the crane, or combinations thereof; and positioning a second connector about a second jib attachment, a second portion of a sheave pin, a second protrusion extending from the boom head of the crane, or combinations thereof.

18. The method of claim 15, wherein the step of positioning the cable in contact with the at least one surface comprises:

positioning the cable between at least two surfaces; and compressing the cable between the at least two surfaces.

19. The method of claim 18, wherein the step of pulling the cable comprises:

pulling the cable between the at least two surfaces; and moving the cable relative to the at least two surfaces, thereby introducing tension into the cable.

* * * * *